US008684026B2

(12) United States Patent
Rundin

(10) Patent No.: US 8,684,026 B2
(45) Date of Patent: Apr. 1, 2014

(54) KEG CLOSURE WITH SAFETY MECHANISM

(75) Inventor: Jessica Rundin, Lidköping (SE)

(73) Assignee: Petainer Lidkoeping AB, Lidkoeping (SE)

( * ) Notice: Subject to any disclaimer, the term of this patent is extended or adjusted under 35 U.S.C. 154(b) by 0 days.

(21) Appl. No.: 13/640,228

(22) PCT Filed: Apr. 11, 2011

(86) PCT No.: PCT/EP2011/055650

§ 371 (c)(1),
(2), (4) Date: Dec. 26, 2012

(87) PCT Pub. No.: WO2011/124724

PCT Pub. Date: Oct. 13, 2011

(65) Prior Publication Data

US 2013/0092689 A1 Apr. 18, 2013

(30) Foreign Application Priority Data

Apr. 9, 2010 (GB) ..... 1005994.7

(51) Int. Cl.
*F16K 43/00* (2006.01)

(52) U.S. Cl.
USPC ... 137/322; 137/212; 222/153.05; 222/400.7; 222/402.14

(58) Field of Classification Search
CPC ..... B67D 1/0832; B67D 1/0838
USPC ..... 137/212, 322; 222/153.05, 153.06, 222/400.7, 402.14
See application file for complete search history.

(56) References Cited

U.S. PATENT DOCUMENTS

| | | | | |
|---|---|---|---|---|
| 4,756,347 | A | 7/1988 | Hagan et al. | |
| 4,909,289 | A | 3/1990 | Hagan et al. | |
| 5,018,552 | A | 5/1991 | Politi et al. | |
| 5,242,092 | A * | 9/1993 | Riis et al. | 222/400.7 |
| 5,657,790 | A * | 8/1997 | Mohn | 137/614.2 |
| 5,713,496 | A * | 2/1998 | Ipsen | 222/400.7 |
| 6,367,660 | B1 * | 4/2002 | Chang | 222/153.09 |
| 7,546,935 | B2 * | 6/2009 | Wheaton | 222/400.7 |
| 2010/0102087 | A1 | 4/2010 | Meike et al. | |

FOREIGN PATENT DOCUMENTS

DE 102007036469 A1 7/2008

* cited by examiner

*Primary Examiner* — John Rivell
*Assistant Examiner* — Reinaldo Sanchez-Medina
(74) *Attorney, Agent, or Firm* — Hultquist PLLC; David Bradin

(57) ABSTRACT

A closure for a keg comprises a housing and a valve element movable within the housing between closed and open positions. A lock mechanism is capable of holding the valve element in the open position, to vent gas from the keg and to thwart unauthorised re-filling after dispensing. The lock mechanism comprises: a first part movable with the valve element that comprises a lock element engageable with the housing; and a second part that is movable with the first part when the valve element moves from the closed position to the open position during filling, and thereafter is separable from the first part as the valve element returns from the open position to the closed position after filling. Separation of those parts enables the lock formation to engage with the housing to hold the valve element when the valve element returns to the open position upon dispensing.

19 Claims, 11 Drawing Sheets

KEG CLOSURE WITH SAFETY MECHANISM

CROSS-REFERENCE TO RELATED APPLICATIONS

This application is s U.S. national phase application under the provisions of 35 U.S.C.§371 of International Patent Application No. PCT/EP2011/055650 filed Apr. 11, 2011, which in turn claims priority of United Kingdom Patent Application No. 1005994.7 filed Apr. 9, 2010. The diclosures of such international patent application and United Kingdom priority patent application are hereby incorporated herein by reference in their respective entireties, for all purpose.

This invention relates to pressurised vessels such as kegs for storing, transporting and dispensing beverages. The invention relates particularly to a closure for a keg, the closure having a safety mechanism to prevent the closure being re-closed after use. This ensures that the keg cannot be left pressurised after use and also that it cannot be refilled with the closure being re-closed afterwards.

Kegs are widely used for the distribution and service of beverages such as beer. A closure in a neck of the keg typically includes a filling and dispensing valve that defines multiple flow paths through the closure. In this way, during filling when the keg is usually inverted, beverage can be injected into the keg through the closure via a first flow path while displaced gas can exit the keg through the closure via a second flow path. Conversely, during dispensing, a propellant gas (typically nitrogen or carbon dioxide) can be injected into the keg through the closure via the first flow path to force beverage out of the keg through the closure along the second flow path. In the most common 'well-type' arrangement, the closure comprises concentric valve elements and concentric flow paths.

When filling the keg at a filling station on a production line, the keg is usually inverted for use with beer and carbonated soft drinks although it could be upright for other beverages, especially those without effervescence, and a filling head is coupled to the closure to form a seal with the closure. The filling head has one or more formations that press against one or more spring-loaded valve elements of the closure to open the flow paths through the closure. Air inside the keg is flushed out with a relatively inert gas, for example carbon dioxide, and beverage is then injected into the keg via a liquid line connected to the filling head. Gas displaced from the keg by the incoming beverage is forced out through a vent in the filling head. When the keg is removed from the filling station, the filling head is uncoupled from the closure and the valve elements of the closure therefore snap shut under spring loading, sealing the beverage and any remaining inert gas within the keg.

For the purpose of dispensing the beverage, a dispense head is coupled to the closure to form a seal with the closure. The dispense head has a lever that, when depressed, extends one or more plungers corresponding to the formations of the filling head. The plunger(s) therefore press against one or more valve elements of the closure to re-open the flow paths through the closure. Those flow paths communicate with gas and liquid lines connected to the dispense head. A propellant gas is injected into the keg from an external source connected to the gas line. Beverage is then forced out of the keg when a tap in the liquid line is opened to dispense the beverage.

When the dispense head is coupled to the closure, the propellant gas is injected into the keg at super-atmospheric pressure. The keg will remain under super-atmospheric pressure unless and until that gas is vented. It is recommended for safety purposes to vent the propellant gas from the keg when the dispense head is uncoupled from the closure, most commonly when the keg has been emptied and is being interchanged with a fresh, full keg. For this purpose, some dispense heads have a purge valve that is operable to vent propellant gas from the keg before the dispense head is uncoupled from the closure.

However, not all dispense heads have a purge valve and even those that do have a purge valve may not be operated correctly. In practice, a user will often be in a hurry to swap empty kegs for full kegs while dispensing beverages in a busy bar and may not therefore take the time necessary to vent the propellant gas from the empty keg. Instead, the user may simply remove the dispense head from the closure, allowing the spring-loaded valve elements of the closure to snap shut and hence to close the flow paths through the closure. The result is that the empty keg remains pressurised, which may not be apparent upon viewing the keg. This is a particular problem where a keg is of flexible material such as blow-moulded polyethylene terephthalate (PET), which is intended to allow the keg to be crushed after use for recycling rather than being returned intact for refilling like a rigid metal keg. Clearly a pressurised keg is not easily crushable. Also, in safety terms, it is undesirable for a pressurised keg to be punctured or ruptured, for example if an attempt is made to crush the keg during waste disposal while believing that the keg is not pressurised.

Another problem is that if the valve element(s) of the closure can still be opened and closed after the original beverage has been dispensed, the keg could possibly be re-filled in an unauthorised manner. For example, the keg could be re-filled with a beverage that is not of the appropriate quality; certainly, the keg is unlikely to be re-filled under the controlled conditions necessary to deliver a beverage in optimum condition. This is particularly undesirable as the keg may bear the brand of the original beverage supplier, whose reputation may be damaged by apparently supplying an inferior product. The keg could even be re-filled with a liquid that is not intended for human consumption and that could be dangerous to drink. Unauthorised refilling may not be apparent from a cursory inspection of the keg.

For these reasons, various keg closures have been proposed in which a valve element can close after filling but cannot close again after dispensing. For example, the proposal disclosed in U.S. Pat. No. 4,909,289 to Hagan et al employs a ratchet arrangement that limits the number of valve openings to allow keg testing and keg filling procedures before the valve element locks open after dispensing.

The proposal in U.S. Pat. No. 4,909,289 is impractical for various reasons. For example, the number of parts in its mechanism, and the way in which those parts interact, leads to long tolerance chains. This renders the mechanism vulnerable to failure where the combined tolerance of the parts causes excessive dimensional fluctuations between different assemblies. Also, the mechanism is not capable of handling the wide variety of filling heads and dispense heads that are available on the market.

A later proposal disclosed in DE 10 2007 036 469 to Schafer Werke involves depressing a valve element to a lesser extent upon coupling a filling head to the closure for filling (i.e. the filling stroke) and to a greater extent upon coupling a dispense head to the closure for dispensing (i.e. the dispense stroke). The greater movement of the valve element through the dispense stroke causes the valve element to lock in a depressed position such that when the dispense head is removed after dispensing, the valve element cannot move back to the closed position.

The proposal disclosed in DE 10 2007 036 469 requires the filling stroke to be shorter than the dispense stroke. However, the use of a well-type fitting involves a filling stroke that is often equal to or sometimes longer than the dispense stroke. The proposal in DE 10 2007 036 469 cannot handle situations where the filling stroke is longer than or equal to the dispense stroke because the valve element will either lock open prematurely during the filling procedure or will fail to lock open after the dispensing procedure.

It is against this background that the present invention has been devised. The invention resides in a closure for a pressure vessel such as a keg, the closure comprising: a housing; at least one valve element movable with respect to the housing between closed and open positions; and a lock mechanism capable of holding the valve element in the open position; wherein the lock mechanism comprises first and second parts, the first part being movable with the valve element and comprising a lock element engageable with a lock formation of the housing to hold the valve element in the open position; and the second part being movable with the first part when the valve element moves from the closed position to the open position, the first part thereafter being movable relative to the second part as the valve element returns from the open position to the closed position, said relative movement between the first and second parts enabling engagement of the lock element with the lock formation of the housing to hold the valve element when the valve element returns to the open position.

Said relative movement between the first and second parts is suitably effected by separation of those parts, although it is possible that the first and second parts could remain attached to one another while they move apart, i.e. that there is relative movement away from each other.

The lock mechanism employed by the invention does not suffer from the long tolerance chains of U.S. Pat. No. 4,909,289 or the inability of U.S. Pat. No. 4,909,289 to handle the variety of filling heads and dispense heads that are on the market. Also, unlike DE 10 2007 036 469, the mechanism of the invention can be used even if the filling stroke is equal to or longer than the dispense stroke.

In the preferred embodiment of the invention to be described below, the closure includes a second valve element concentric with and movable axially relative to a first valve element.

It is preferred that as the second part moves with the first part when the valve element moves from the closed position to the open position, the second part prevents the lock element of the first part engaging with the lock formation of the housing. This ensures reliable operation in which the valve element can return to the closed position after filling without prematurely locking in the open position.

Before separation or other enabling relative movement, the first and second parts of the lock mechanism may be engaged with each other: the second part may, for example, comprise a catch formation that restrains the lock element of the first part before the first and second parts are separated.

When enabled for engagement with the lock formation of the housing, the lock element of the first part is preferably movable initially with respect to the housing without engaging the lock formation of the housing. This allows the valve element to move back into the closed position and thereafter to move from the closed position toward the open position, and then to engage the lock formation of the housing to hold the valve element in the open position.

The lock formation of the housing may, conveniently, be an opening in a wall of the housing into which the lock element of the first part moves for engagement. In that case, the lock element of the first part may slide against the wall of the housing adjacent the opening to enable the abovementioned initial movements of the valve element when the lock element is enabled for engagement with the opening.

The closure of the invention is conventionally operable by axially inward movement of the valve member with respect to the housing between the closed and open positions, in which case the second part of the lock mechanism is preferably disposed axially inwardly with respect to the first part of the lock mechanism. This enables the first part of the lock mechanism to move the second part of the lock mechanism. For example, the first part may bear against the second part to move the second part axially inwardly with respect to the housing as the valve element moves from the closed position to the open position.

Advantageously, the second part includes a latch element engageable with one or more latch formations of the housing to hold the second part relative to the housing. This ensures separation of the second part from the first part, or other enabling relative movement between the parts, as the first part moves with the valve element when the valve element moves relative to the housing from the open position to the closed position. To control the position and movement of the second part, it is preferred that the latch element can disengage from a latch formation upon further axially inward movement of the second part with respect to the housing. For example, as the valve element moves from the closed position to the open position, the latch element of the second part may disengage from an axially outer latch formation to engage with an axially inner latch formation in the manner of a ratchet.

To reduce slack in the assembly, a bias member such as a leaf spring may act between the housing and the second part. The bias member biases the second part axially outwardly after said relative movement between the first and second parts enables engagement of the lock element with the lock formation of the housing.

Of course, the inventive concept extends to a pressure vessel such as a keg, fitted with the closure of the invention.

In order that the invention may be more readily understood, reference will now be made, by way of example, to the accompanying drawings in which:

FIG. 1 is a sectional side view through a closure in accordance with an embodiment of the invention, fitted in the neck of a plastics keg, showing the closure before filling with both valve elements closed;

FIG. 2 corresponds to FIG. 1 but shows the closure during filling when a filling head has been coupled to the closure, with both valve elements open;

FIG. 3 corresponds to FIGS. 1 and 2 but shows the closure after filling when the filling head has been uncoupled from the closure, with both valve elements again closed;

FIG. 4 corresponds to FIGS. 1 to 3 but shows the closure during dispensing when a dispense head has been coupled to the closure, with both valve elements again open;

FIG. 5 corresponds to FIGS. 1 to 4 but shows the closure after dispensing when the dispense head has been uncoupled from the closure, with one valve element now permanently open;

Figure 7:
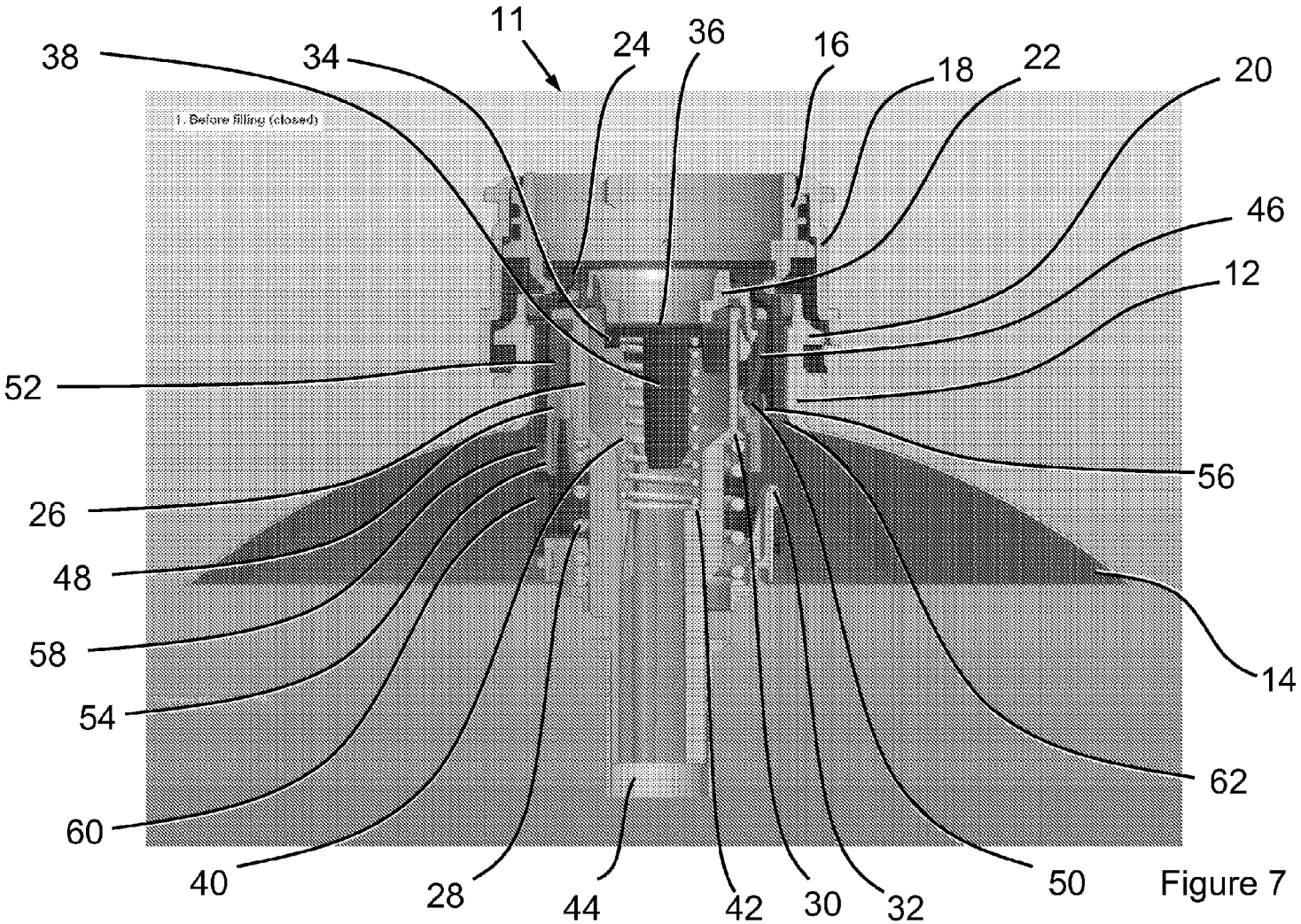
FIG. 7 is a sectional side view of the closure of FIG. 6, fitted in the neck of a plastics keg, showing the closure before filling with both valve elements closed.
Figure 8:
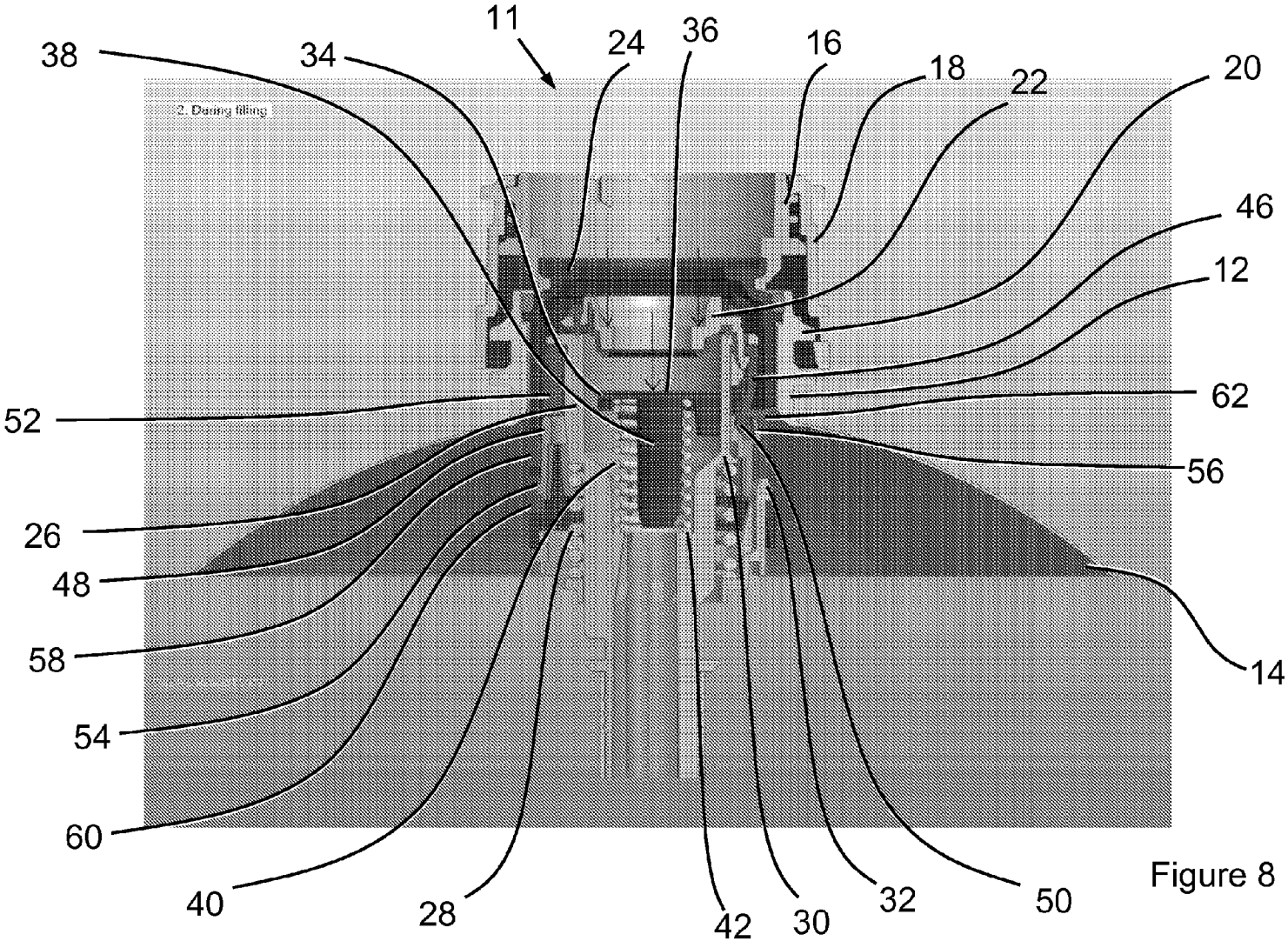
Figure 9:
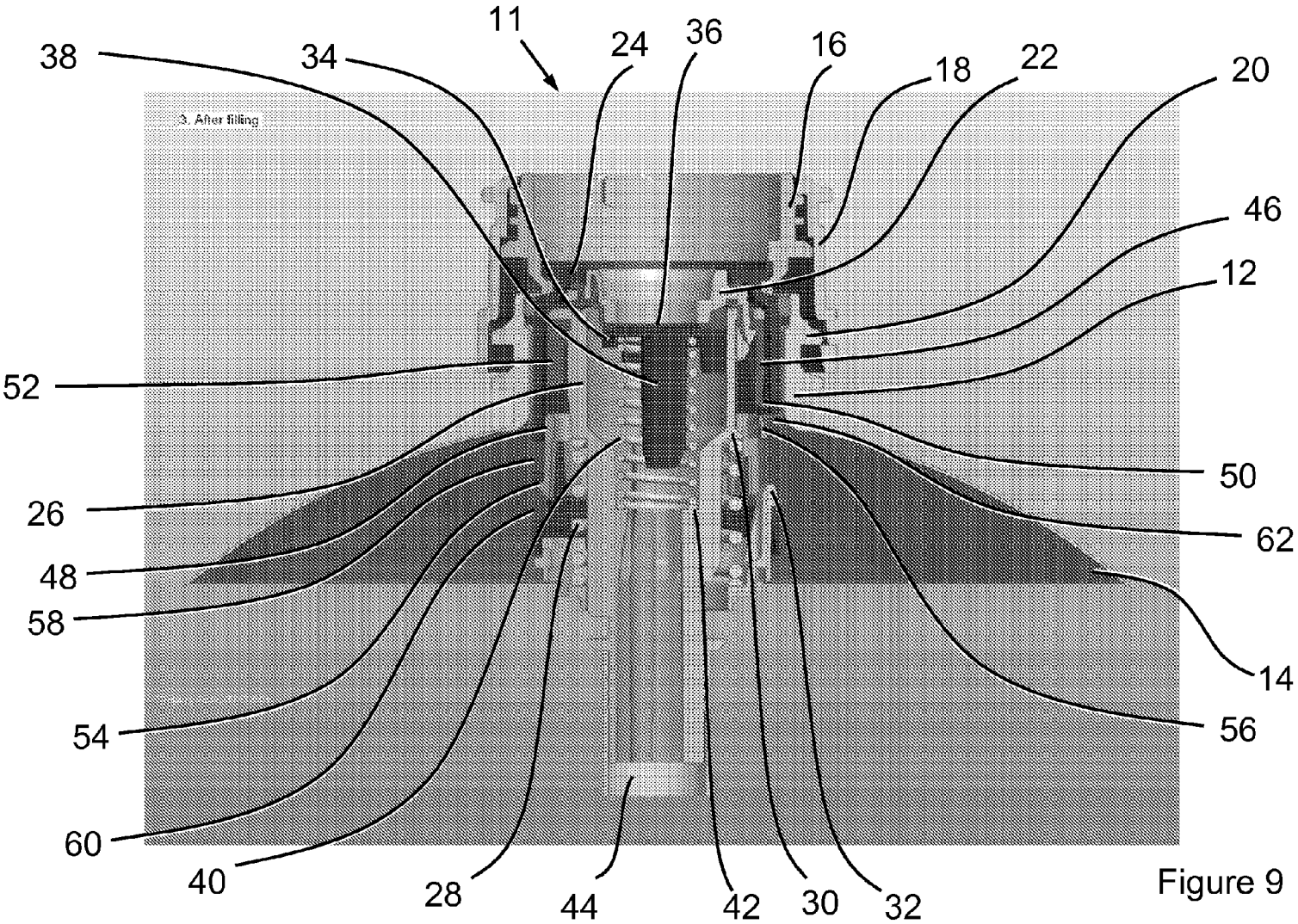
Figure 10:
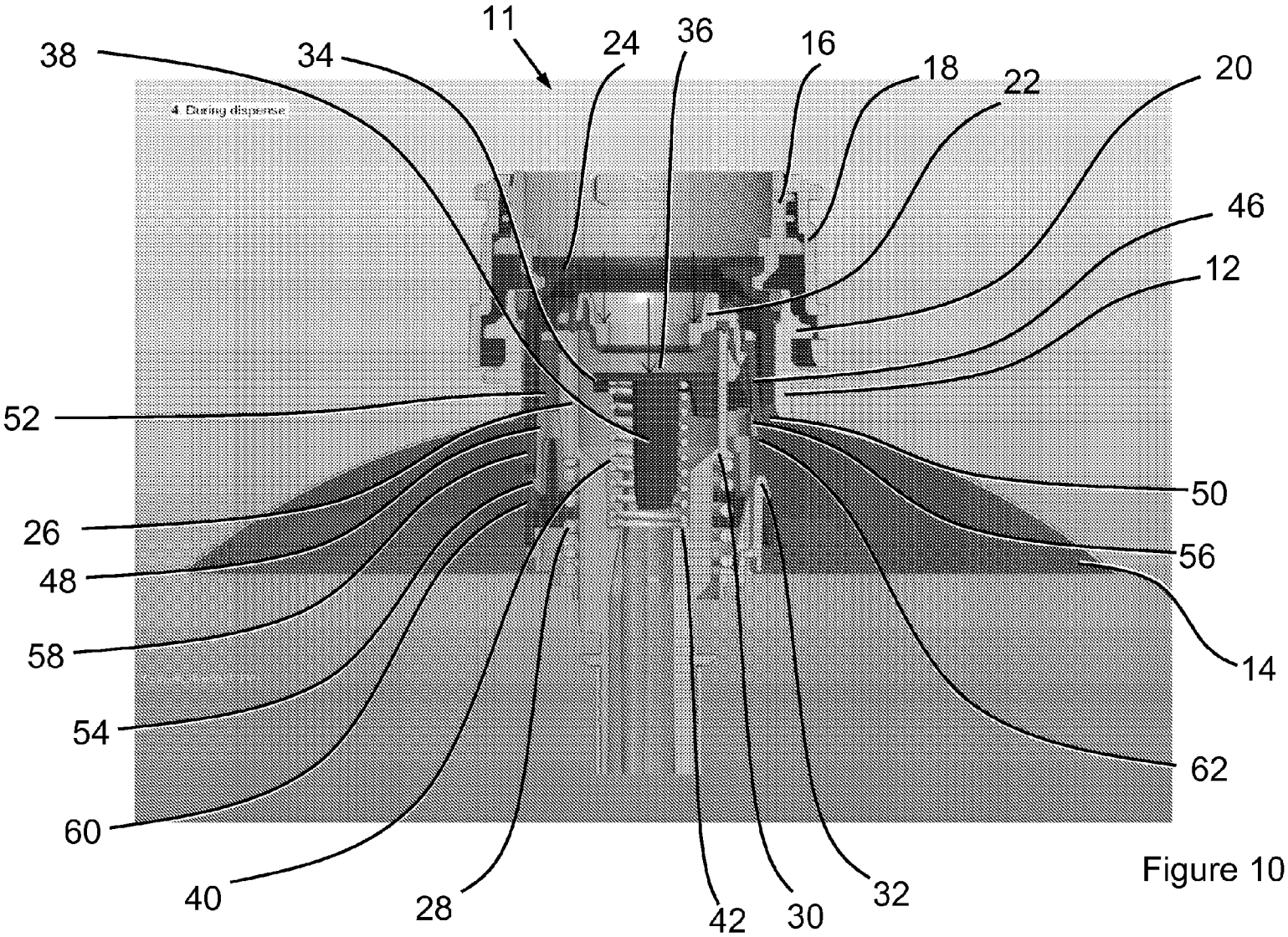
Figure 11:
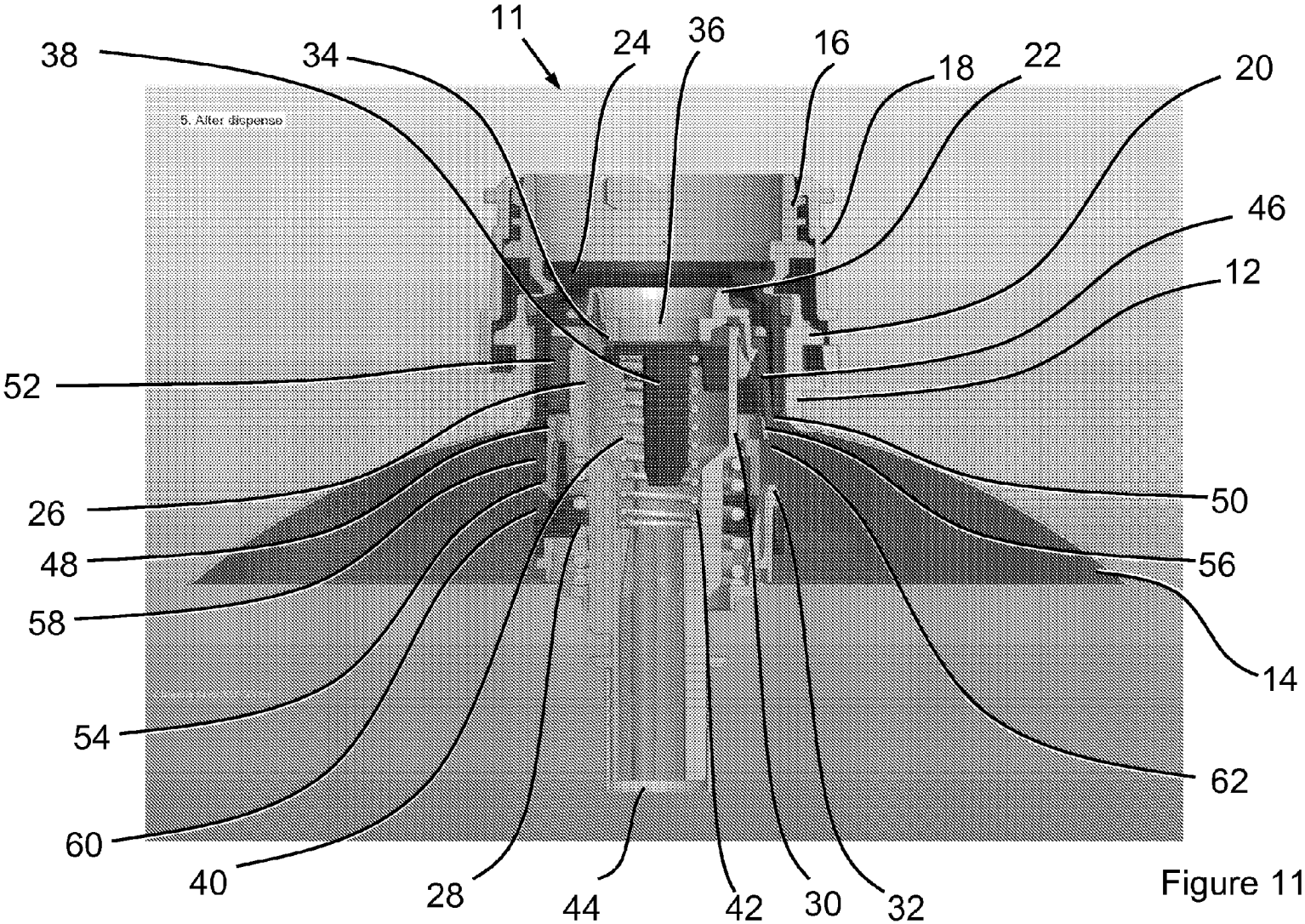

FIG. 8 corresponds to FIG. 7 but shows the closure during filling when a filling head has been coupled to the closure, with both valve elements open;

FIG. 9 corresponds to FIGS. 7 and 8 but shows the closure after filling when the filling head has been uncoupled from the closure, with both valve elements again closed;

FIG. 10 corresponds to FIGS. 7 to 9 but shows the closure during dispensing when a dispense head has been coupled to the closure, with both valve elements again open; and FIG. 11 corresponds to FIGS. 7 to 10 but shows the closure after dispensing when the dispense head has been uncoupled from the closure, with one valve element now permanently open.

FIGS. 1 to 5 of the drawings show a well-type closure 10 fitted into the neck 12 of a keg 14. In this example, the keg 14 is of plastics material such as blow-moulded PET. The components of the closure 10 are made predominantly of injection-moulded plastics materials such as polyester, polyolefin, polyamide or the like, except where stated otherwise below. It is emphasised that the materials used for the keg 14 and the closure 10 and their methods of manufacture are merely preferred and are not essential to the broad inventive concept.

The closure 10 has a generally tubular housing 16 shaped to fit closely within the tubular neck 12 of the keg 14. The housing 16 is retained on the keg 14 by a snap ring 18 that resiliently engages circumferential ridges 20 projecting laterally from the exterior of the neck 12. The housing 16 surrounds and supports concentric valve elements that are axially displaceable against spring bias inwardly toward the interior of the keg 14 to open them. As the valve elements open, they open respective concentric flow paths extending through the closure 10 and into the keg 14.

An outer valve comprises a first valve element including an annular seal 22 whose upper outer edge seals against a frustoconical outer valve seat 24 extending radially inwardly from the housing 16 with respect to the central longitudinal axis of the neck 12. The seal 22 is supported by, and moves axially with, a tubular spear connector 26. An outer coil spring 28 of stainless steel surrounds the lower portion of the spear connector 26 and acts in compression between an outer flange 30 extending radially outwardly from the spear connector 26 with respect to the central longitudinal axis of the neck 12 and a lock ring 32 snap-fitted to the bottom of the housing 16. The outer coil spring 28 biases the spear connector 26 outwardly away from the interior of the keg 14, urging the seal 22 into sealing contact with the outer valve seat 24.

The spear connector 26, in turn, surrounds and supports a second valve element being a plug 34 that is movable axially with respect to the spear connector 26 relative to the seal 22. The plug 34 comprises a head 36 and a stem 38 in a generally T-shape arrangement. The head 36 of the plug 34 cooperates with the lower inner edge of the seal 22 to define an inner valve. An inner coil spring 40 of stainless steel surrounds the stem 38 of the plug 34 and acts in compression between the head 36 of the plug 34 and an inner flange 42 extending inwardly within the spear connector 26. The inner coil spring 40 thus urges the head 36 of the plug 34 outwardly away from the interior of the keg 14, into sealing contact with the lower inner edge of the seal 22.

A tube 44 communicating with the hollow interior of the spear connector 26 extends into the base of the keg 14 from the inner end of the spear connector 26. The tube 44 is typically of extruded plastics material such as polyethylene.

Figure 1:
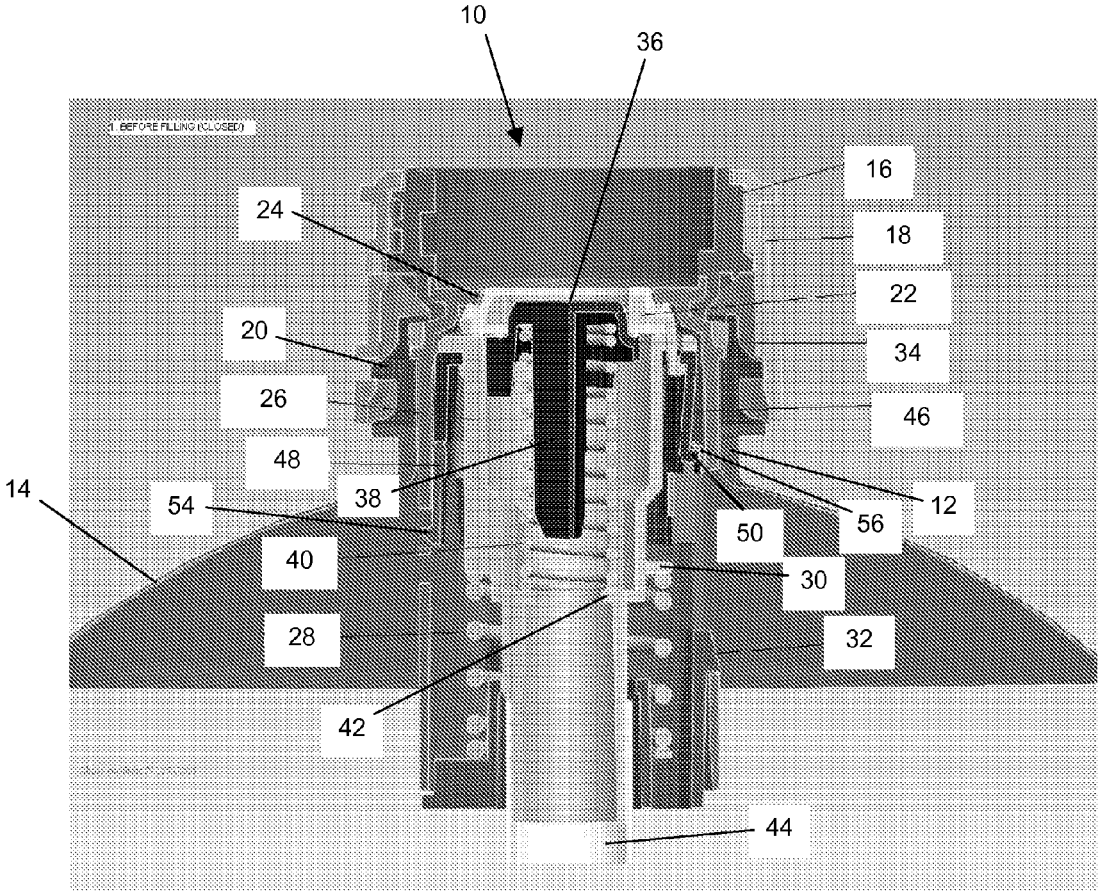
Figure 3:
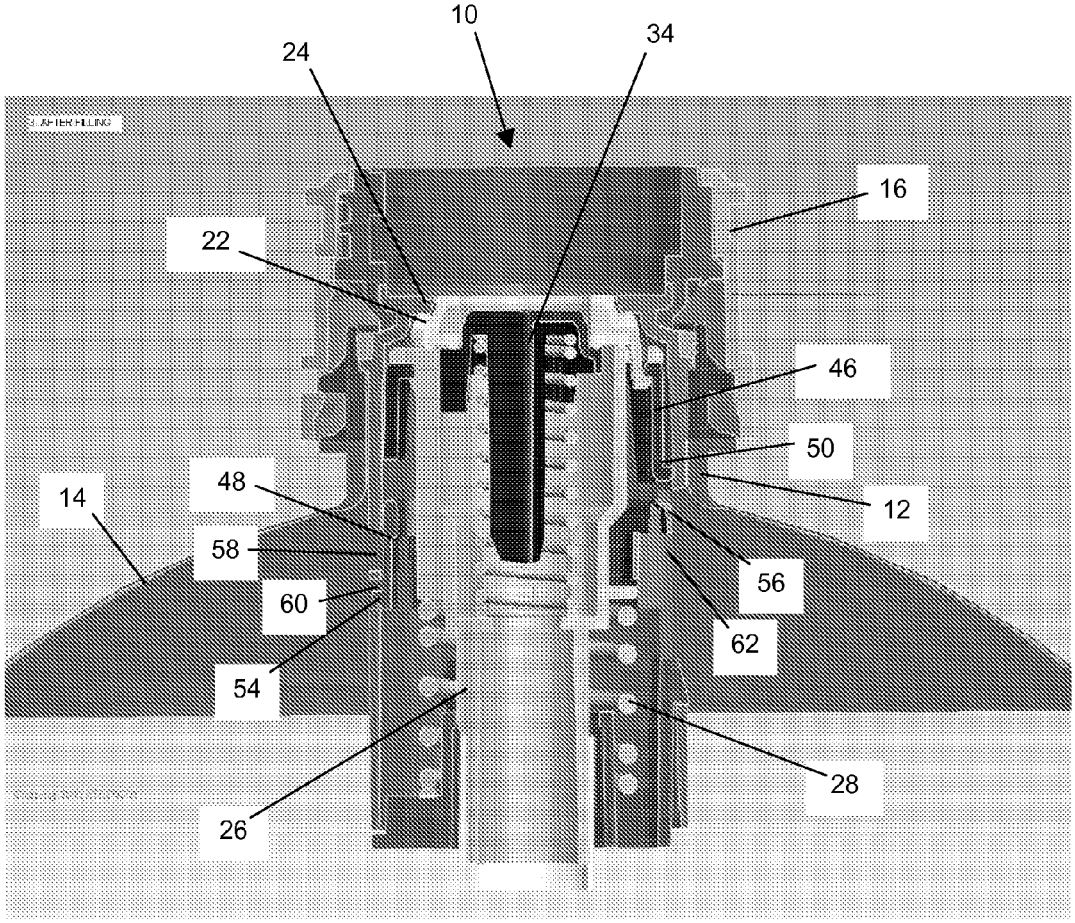

FIGS. 1 and 3 of the drawings show the closure 10 with both valve elements closed: thus the upper outer edge of the seal 22 is in sealing contact with the outer valve seat 24 and the head 36 of the plug 34 is in sealing contact with the lower inner edge of the seal 22.

Figure 2:
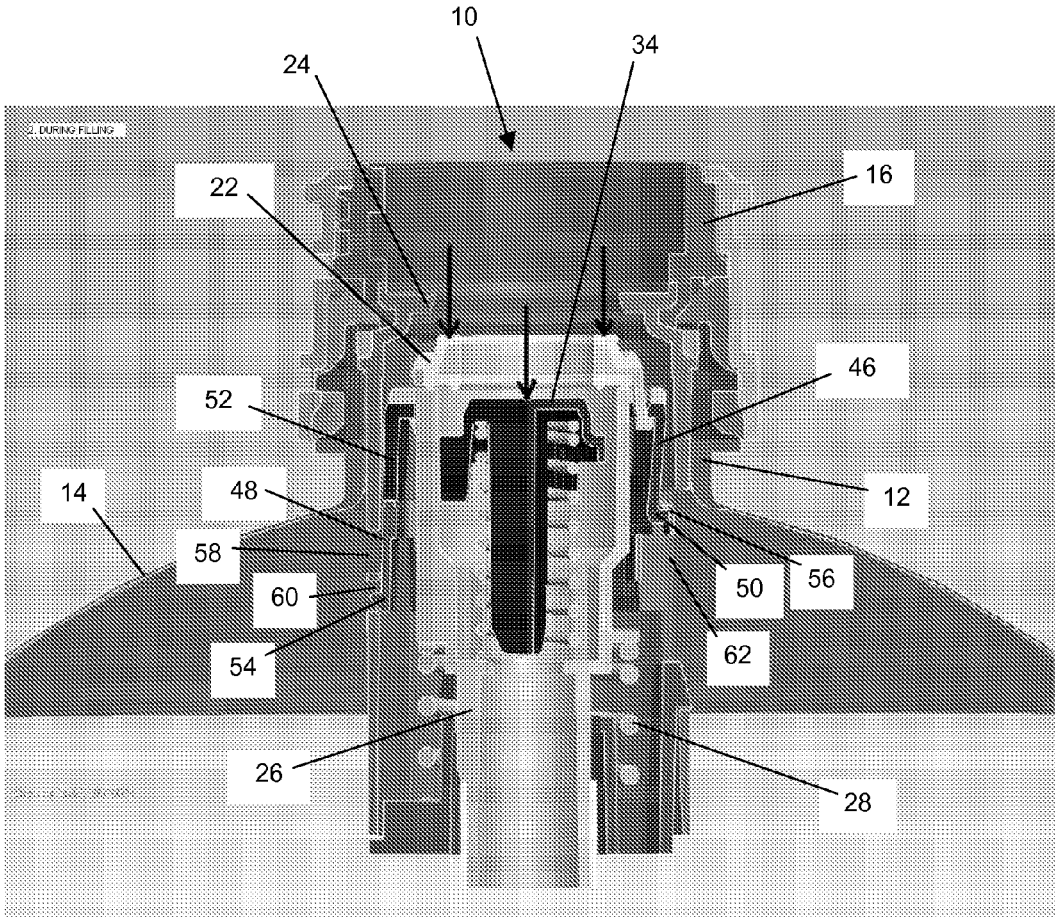
Figure 4:
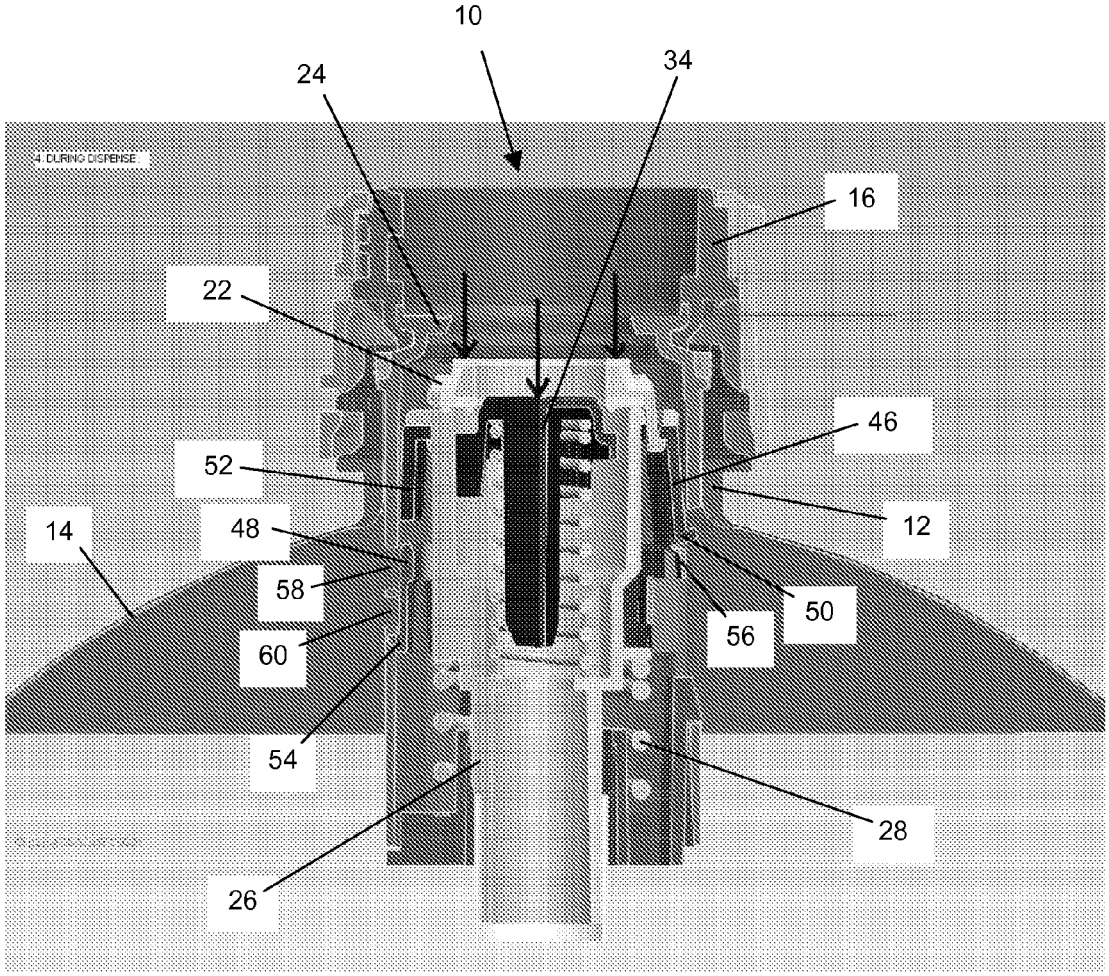

A filling head and a dispense head for use with the closure 10 of the invention are conventional and so are omitted from the drawings. However the forces they apply to the valve elements of the closure 10, and their resulting effect on the valve elements, is represented by the arrows in FIGS. 2 and 4 of the drawings. FIGS. 2 and 4 show the closure 10 with both valve elements open. When a filling head is coupled to the closure 10 as represented by the arrows in FIG. 2, concentric formations on the filling head press inwardly on the seal 22 and on the plug 34, depressing them toward the interior of the keg 14. Similarly when a dispense head is coupled to the closure 10 as represented by the arrows in FIG. 4, concentric plungers on the dispense head also press inwardly on the seal 22 and on the plug 34, depressing them toward the interior of the keg 14, albeit to a slightly lesser extent for the plug 34 than during the filling operation shown in FIG. 2.

When the seal 22 is pushed inwardly toward the interior of the keg 14 as shown in FIGS. 2 and 4, the seal 22 moves away from the outer valve seat 24 to permit fluid flow along an outer flow path around the spear connector 26. Similarly when the plug 34 is also pushed inwardly toward the interior of the keg 14 with respect to the seal 22 as shown in FIGS. 2 and 4, the plug 34 moves away from the lower inner edge of the seal 22 to permit fluid flow along an inner flow path around the stem 38 of the plug 34.

In practice, beverage will flow into the keg 14 along the outer flow path during filling in FIG. 2 and from the keg 14 along the inner flow path during dispensing in FIG. 4. Conversely, gas will flow from the keg 14 along the inner flow path during filling in FIG. 2 and into the keg 14 along the outer flow path during dispensing in FIG. 4. The beverage and gas flows specified during filling assume that the keg 14 is inverted during filling, which is conventional for effervescent drinks such as beer. However it is also possible to fill the keg 14 with suitable beverages when upright, in which case beverage will flow into the keg 14 along the inner flow path and gas will flow from the keg 14 along the outer flow path.

In general terms, the above features of the closure 10 are largely conventional. The invention resides in a lock mechanism that, in this example, comprises two separable parts, namely a ratchet clip 46 and a ratchet tube 48 disposed axially inwardly of the ratchet clip 46, toward the interior of the keg 14.

The ratchet clip 46 is attached to the exterior of the spear connector 26 near its axially outer end with respect to the interior of the keg 14, and lies between the spear connector 26 and the surrounding housing 16. The ratchet clip 46 moves with, or—as will be explained—restrains movement of, the spear connector 26 and hence the seal 22 with respect to the housing 16. The ratchet clip 46 comprises an integrally-moulded lock element 50 on one side that is resiliently biased transversely outwardly with respect to the central longitudinal axis of the neck 12. An integrally-moulded leg 52 depends from the ratchet clip 46 on the opposite side diametrically opposed to the lock element 50, that leg extending axially inwardly toward the interior of the keg 14.

The ratchet tube 48 also lies between the spear connector 26 and the surrounding housing 16. The sleeve-like ratchet tube 48 is a sliding fit within the housing 16, being movable axially inwardly toward the interior of the keg 14 parallel to the central longitudinal axis of the neck 12. The ratchet tube 48 comprises an integrally-moulded latch element 54 that, like the lock element 50 of the ratchet clip 46, is resiliently biased transversely outwardly with respect to the central longitudinal axis of the neck 12. The latch element 54 of the ratchet tube 48 is angularly aligned with the leg 52 of the ratchet clip 46. The ratchet tube 48 further comprises an integrally-moulded catch formation 56 on the opposite side diametrically opposed to the latch element 54, the catch formation 56 therefore being angularly aligned with the lock element 50 of the ratchet clip 46.

The side wall of the housing 16 comprises, on one side, latch formations being a pair of slots 58, 60 that are angularly aligned with each other and with the latch element 54 of the ratchet tube 48. The pair of slots 58, 60 comprises an outer slot 58 and an inner slot 60, outer and inner being expressed in this instance axially with respect to the interior of the keg 14. The side wall of the housing 16 further comprises a lock formation being an opening 62 on the other side, diametrically opposed to the pair of slots 58, 60 and thus being angularly aligned with the lock element 50 of the ratchet clip 46.

Initially, before filling, the seal 22 and the plug 34 are urged by spring bias against the outer valve seat 24 and the seal 22 respectively to close the outer and inner valves. This situation is shown in FIG. 1. Here, the ratchet tube 48 is in a start position in which its latch element 54 is engaged with the outer slot 58 in the side wall of the housing 16. The leg 52 of the ratchet clip 46 is in contact with the ratchet tube 48 in angular alignment with the latch element 54 of the ratchet tube 48. On the opposite side, the catch formation 56 of the ratchet tube 48 holds the lock element 50 of the ratchet clip 46 radially inwardly against its resilient bias with respect to the central longitudinal axis of the neck 12, thus also connecting the ratchet tube 48 to the ratchet clip 46.

When the seal 22 and the plug 34 are depressed to open the outer and inner valves during filling as shown in FIG. 2, the seal 22 moves the spear connector 26 axially inwardly toward the interior of the keg 14 against spring bias and the ratchet clip 46 moves axially inwardly with the spear connector 26. In doing so, the leg 52 of the ratchet clip 46 bears against the ratchet tube 48, sliding the ratchet tube 48 axially inwardly from its start position to an inner locked position in which the latch element 54 of the ratchet tube 48 has disengaged from the outer slot 58 and instead engages with the inner slot 60 in the side wall of the housing 16.

Up to this point, the ratchet tube 48 remains connected to the ratchet clip 46 by virtue of the engagement of the lock element 50 of the ratchet clip 46 with the catch formation 56 of the ratchet tube 48. However when filling is complete and the outer and inner valves are allowed to close again as shown in FIG. 3, the ratchet tube 48 is restrained against axial movement away from the interior of the keg 14 from its locked position by engagement of its latch element 54 with the inner slot 60 in the side wall of the housing 16. Thus, the force of the outer coil spring 28 acting on the spear connector 26 (and hence on the ratchet clip 46 attached to the spear connector 26) disengages the lock element 50 of the ratchet clip 46 from the catch formation 56 of the ratchet tube 48, allowing the ratchet clip 46 to move axially away from the interior of the keg 14 and hence to separate from the ratchet tube 48.

When it disengages from the catch formation 56 of the ratchet tube 48, the lock element 50 of the ratchet clip 46 is freed to move radially outwardly under its resilient bias, transversely with respect to the central longitudinal axis of the neck 12. This enables the lock element 50 to hold the ratchet clip 46 and hence the spear connector 26 and the seal 22 when the outer valve is subsequently re-opened, as will be explained. However when the ratchet clip 46, the spear connector 26 and the seal 22 are at or near their axially outermost position furthest from the interior of the keg 14—that position being consistent with the outer valve being closed—the wall of the housing 16 restrains outward movement of the lock element 50 of the ratchet clip 46 as shown in FIG. 3.

Once the keg 14 is filled, the closure 10 is preferably covered with means for dust protection and tamper evidence, such as a foil cap (not shown). The filled keg 14 may then be stored and delivered to customers for dispensing as required. To facilitate transportation, a handle (not shown) may be attached to the neck 12 of the keg 14.

FIG. 4 shows that when the seal 22 and the plug 34 are depressed again to open the outer and inner valves for dispensing, the seal 22 moves the spear connector 26 axially inwardly against spring bias toward the interior of the keg 14 and the ratchet clip 46 moves axially inwardly with the spear connector 26. In doing so, the lock element 50 of the ratchet clip 46 moves axially inwardly toward the interior of the keg 14 to an extent sufficient to engage with the axially outer edge of the opening 62 in the side wall of the housing 16, snap-fitting into that opening 62 with resilient radially outward movement that then is no longer restrained by the adjacent wall of the housing 16 disposed axially outward of the opening 62. The lock element 50 of the ratchet clip 46 now bears against, but does not re-engage with, the catch formation 56 of the ratchet tube 48. This pushes the ratchet tube 48 further axially inwardly to the extent required to open the outer valve.

Figure 5:
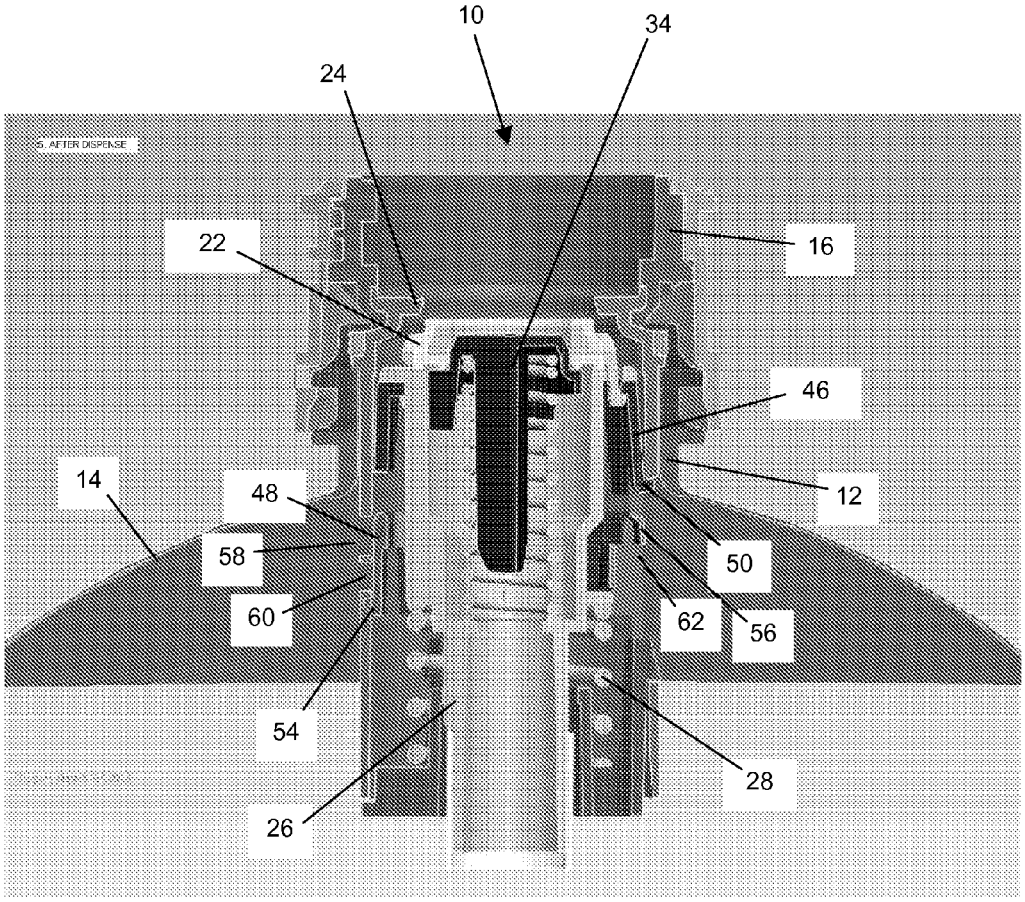

When the seal 22 and the plug 34 are released again as shown in FIG. 5, the inner valve is able to close because the head 36 of the plug 34 is free to seal 22 against the seal 22 attached to the spear connector 26. However the spear connector 26 is no longer able to move axially outwardly away from the interior of the keg 14 to an extent necessary for the seal 22 to contact the outer valve seat 24 of the housing 16, so the outer valve can no longer close. This is because the lock element 50 of the ratchet clip 46 has engaged with the opening 62 in the side wall of the housing 16, thus causing the ratchet clip 46 to restrain axial movement of the spear connector 26 rather than passively moving with the spear connector 26 as previously.

In this way, the mechanism of the invention ensures that the keg cannot be left pressurised after use and also that it cannot be refilled with the closure being re-closed afterwards. As noted above, the mechanism of the invention does not suffer from the long tolerance chains of U.S. Pat. No. 4,909,289 or the inability of U.S. Pat. No. 4,909,289 to handle the variety of filling heads and dispense heads that are on the market. Also, unlike DE 10 2007 036 469, the mechanism of the invention can be used even if the filling stroke is equal to or longer than the dispense stroke.

FIGS. 6 to 11 show an alternative closure to that shown in FIGS. 1 to 5. FIGS. 7 to 11 correspond to FIGS. 1 to 5, in that they show the alternative closure in different configurations. In particular, FIGS. 7 to 11 respectively show the alternative closure 11, before filling, during filling, after filling, during dispensing and after dispensing.

The closure 11 shown in FIGS. 6 to 11 is similar in structure and function to the closure 10 shown in FIGS. 1 to 5. In the interests of brevity, the following description will focus on the differences between the two closures and the same reference numerals have been used for like structures.

Figure 6:
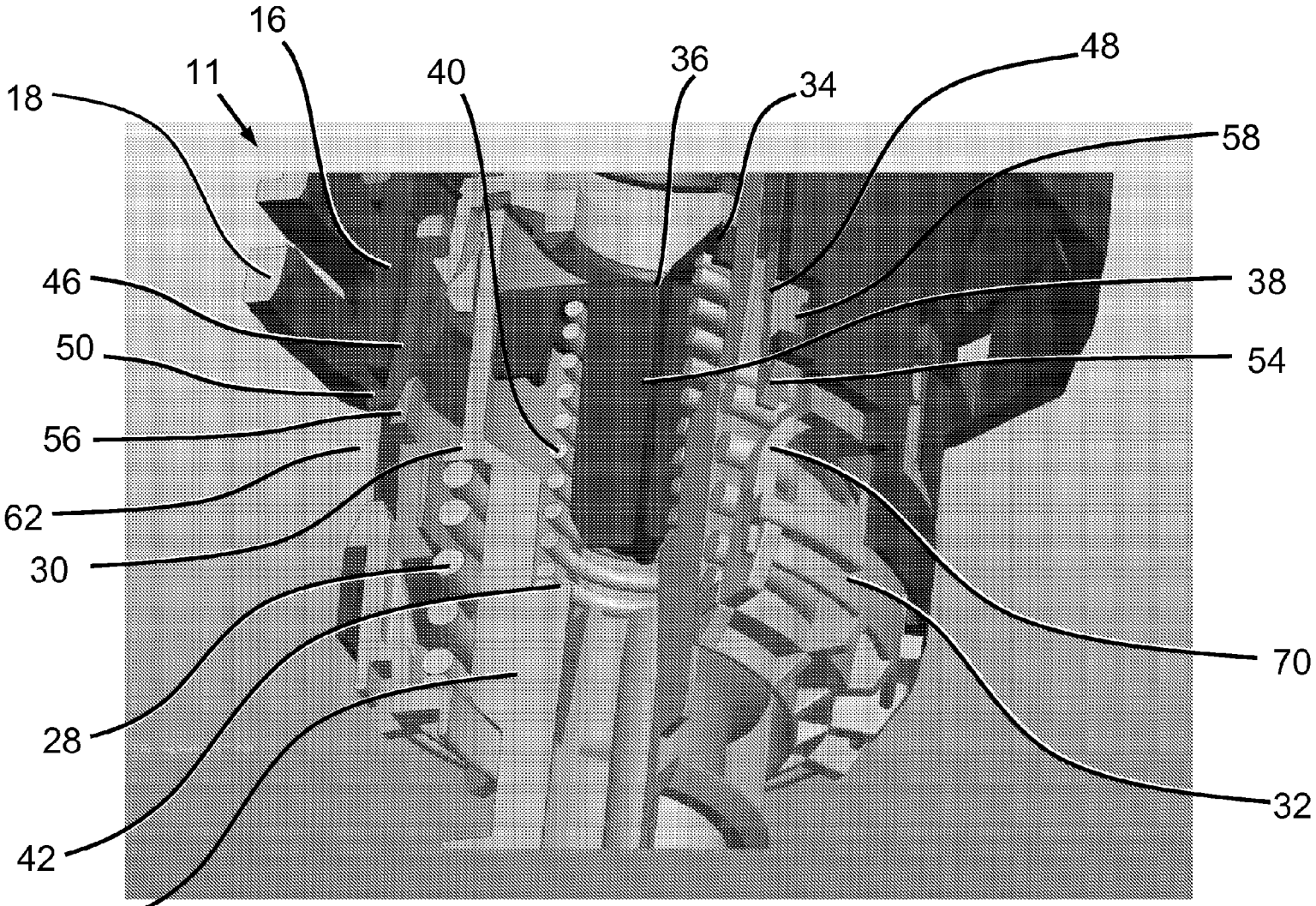
FIG. 6 is a cut-away perspective view through a closure alternative to that shown in FIG. 1, in isolation from a keg, showing the closure during dispensing when a dispense head has been coupled to the closure, with both valve elements open.

FIG. 6 is a cut-away perspective view through the closure 11. It should be noted that the view direction of the closure 11 in FIG. 6 is opposite to that of FIGS. 1 to 5 and FIGS. 7 to 11. Accordingly, features such as the lock element 50 and catch formation 56 that are shown in other drawings as being on the right are instead shown on the left in FIG. 6. Furthermore, although FIG. 6 is a cut-away view of the closure, the section taken through the closure is not planar. Rather the section is defined by two planes radiating from the central longitudinal axis of the closure 10 at an obtuse angle from one another.

FIG. 6 shows the closure 11 during dispensing when a dispense head has been coupled to the closure, with both valve elements open. However, neither the dispense head nor the plastics keg to which the keg is fitted are shown in this drawing.

The closure 11 differs from the previously presented closure 10 in that it comprises a leaf spring 70 that is integrally moulded with the lock ring 32 snap-fitted to the bottom of the housing 16. The leaf spring 70 is rooted in the lock ring 32, and extends axially upwards and curves radially outwards from its root. In cross-section, the leaf spring 70 tapers from its root to its axially-upper and radially-outer end, and has a substantially regular cross-section as taken through any radially-extending plane from the central longitudinal axis of the closure 11. Accordingly, the leaf spring 70 defines an axially-outwardly facing surface that, as shown in FIG. 6, bears resiliently against a cooperating axially-inwardly facing surface of the ratchet tube 48. The leaf spring 70 can thereby bias the ratchet tube 48 away from the lock ring 32 and so against the housing 16 of the closure 11 when the leaf spring 70 is in contact with the ratchet tube 48.

Briefly, the function of the leaf spring 70 is to bias the ratchet tube 48 axially upwardly or outwardly after the filling stroke. As will be described, this ensures that the lock element 50 of the ratchet clip 46 is correctly guided into the lock formation defined by the opening 62 during and after the dispensing stroke to prevent the closure 11 from re-closing after use.

As mentioned previously in respect of the closure 10 of FIGS. 1 to 5, and as is the case with the closure 11, the lock element 50 is resiliently biased transversely outwardly with respect to the central longitudinal axis of the closure 11. Thus, after filling, during the transition from the configuration of the closure 11 shown in FIG. 8 to that of FIG. 9, the lock element 50 disengages from the catch formation 56 of the ratchet tube 48, and the lock element 50 is freed to move radially outwardly under its resilient bias. Furthermore, during dispensing (i.e. to the configuration shown in FIG. 10) the lock element 50 of the ratchet clip 46 moves axially inwardly toward the interior of the keg 14 to an extent sufficient to engage with the axially outer edge of the opening 62 in the side wall of the housing 16.

In particular, it is intended that the lock element 50 snap-fits into that opening 62 via its resilient radially outward movement. However, if the lock element 50 is not sufficiently biased, then it could fail to lock into the lock formation defined by the opening 62. This failure may arise as a result of the ratchet clip 46 losing some of its resilience over the period during which it is radially-constrained by the ratchet clip 46. If this is the case, the ratchet clip 46 may have sufficient flexibility to snap out of engagement with the catch formation 46, but insufficient resilience to snap completely into the lock formation defined by the opening 62.

To guard against this, the catch formation 56 of the ratchet tube 48 helps to guide the lock element 50 into the opening 62. To ensure this guidance, the ratchet tube 48 is biased axially upwards or outwards by the leaf spring 70 after the ratchet tube 48 and the ratchet clip 46 have become separated following the filling stroke.

Although the ratchet tube 48, at this stage, has its axially upward movement constrained by virtue of its latch element 54 being locked into the inner slot 60 in the side wall of the housing 16, the ratchet tube 48 is still able to shuttle in the axial direction between upper and lower positions. At the upper position, the latch element 54 is in contact with the upper edge defined in the housing 16 by the inner slot 60. At the lower position, the latch element 54 is spaced from that upper edge.

In the arrangement of the closure 10 described with reference to FIGS. 1 to 5, the position of the ratchet tube 48 between the upper and lower positions is not precisely determined. However, in the closure 11 of FIGS. 6 to 11, the leaf spring 70 biases the ratchet tube 48 against the lock ring 32 to its upper position. This removes slack or backlash in the assembly.

At this position, the catch formation 56 of the ratchet tube 48 is radially adjacent to the axially upper end of the opening 62. The axially upper portion of the catch formation 46 defines an axially-upwardly and radially-outwardly-facing surface that is axially opposite a complementarily-shaped axially-downwardly and radially-inwardly facing surface of the axially lower portion of the lock element 50.

Accordingly, as the closure 11 switches from the configuration shown in FIG. 9 to that of FIG. 10, the ratchet clip 46 is moved axially inwards, and the complementarily-shaped surfaces of the lock element 50 and the catch formation 46 contact and slide past one another. In particular, the lock element 50 is cammed radially outwards, and is thereby guided into the lock formation defined by the opening 62. The catch formation 46 thereby acts as a guide for guiding the lock element 50 into position within the lock formation defined by the opening 62.

This facilitates the engagement between the lock element 50 and the opening 62, thereby ensuring that the closure 11 cannot be re-closed after dispensing.

The invention claimed is:

1. A closure for a pressure vessel, the closure comprising:

a housing;

at least one valve element movable with respect to the housing between closed and open positions; and a lock mechanism capable of holding the valve element in the open position;

wherein the lock mechanism comprises first and second parts, the first part being movable with the valve element and comprising a lock element engageable with a lock formation of the housing to hold the valve element in the open position; and the second part being movable with the first part when the valve element moves from the closed position to the open position, the first part thereafter being movable relative to the second part as the valve element returns from the open position to the closed position, said relative movement between the first and second parts enabling engagement of the lock element with the lock formation of the housing to hold the valve element when the valve element returns to the open position.

2. The closure of claim 1, wherein said relative movement between the first and second parts is effected by separation of those parts.

3. The closure of claim 2, wherein as the second part moves with the first part when the valve element moves from the closed position to the open position, the second part prevents the lock element of the first part engaging with the lock formation of the housing.

4. The closure of claim 1, wherein the second part comprises a catch formation that restrains the lock element of the first part before said relative movement between the first and second parts.

5. The closure of claim 1, wherein when enabled for engagement by said relative movement between the first and second parts, the lock element of the first part is initially movable with respect to the housing without engaging the lock formation of the housing, to allow the valve element to move into the closed position.

6. The closure of claim 1, wherein when enabled for engagement by said relative movement between the first and second parts, the lock element of the first part is initially movable with respect to the housing without engaging the lock formation of the housing to allow the valve element to move from the closed position toward the open position, and then engages the lock formation of the housing to hold the valve element in the open position.

7. The closure of claim 1, wherein the lock formation of the housing is an opening in a wall of the housing into which the lock element of the first part moves for engagement.

8. The closure of claim 7 wherein when enabled for engagement by said relative movement between the first and second parts, the lock element of the first part is initially movable with respect to the housing without engaging the lock formation of the housing, to:

i) allow the valve element to move into the closed position, or ii) to move from the closed position toward the open position, and then engage the lock formation of the housing to hold the valve element in the open position, and, wherein the lock element of the first part slides against the wall of the housing adjacent the opening to enable said initial movements of the valve element when the lock element is enabled for engagement by said relative movement between the first and second parts.

9. The closure of claim 1 and being operable by axially inward movement of the valve member with respect to the housing between the closed and open positions, wherein the second part of the lock mechanism is disposed axially inwardly with respect to the first part of the lock mechanism.

10. The closure of claim 9, wherein the first part bears against the second part to move the second part axially inwardly with respect to the housing as the valve element moves from the closed position to the open position.

11. The closure of claim 1, wherein the second part includes a latch element engageable with one or more latch formations of the housing to hold the second part relative to the housing, thereby effecting said relative movement between the first and second parts as the first part moves with the valve element relative to the housing when the valve element moves from the open position to the closed position.

12. The closure of claim 11, wherein the latch element can disengage from a latch formation upon further axially inward movement of the second part with respect to the housing.

13. The closure of claim 11, wherein as the valve element moves from the closed position to the open position, the latch element of the second part disengages from an axially outer latch formation to engage with an axially inner latch formation in the manner of a ratchet.

14. The closure of claim 1, wherein, before said relative movement, the first and second parts of the lock mechanism are engaged with each other.

15. The closure of claim 1 and including a second valve element concentric with and movable axially relative to a first valve element.

16. The closure of claim 1, wherein a bias member acts between the housing and the second part to bias the second part axially outwardly after said relative movement between the first and second parts enables engagement of the lock element with the lock formation of the housing.

17. A pressure vessel, fitted with the closure of claim 1.

18. The pressure vessel of claim 17, wherein the vessel is a keg.

19. The closure of claim 1, wherein the vessel is a keg.

* * * * *